US009764879B2

(12) United States Patent
Koenigseder et al.

(10) Patent No.: US 9,764,879 B2
(45) Date of Patent: Sep. 19, 2017

(54) DISPENSING CLOSURE

(71) Applicant: Aptar Freyung GmbH, Freyung (DE)

(72) Inventors: Bruno Koenigseder, Roehrnbach (DE); Andreas Rueckert, Ringelai (DE); Alexander Stifter, Freyung (DE)

(73) Assignee: Aptar Freyung GmbH (DE)

( * ) Notice: Subject to any disclaimer, the term of this patent is extended or adjusted under 35 U.S.C. 154(b) by 10 days.

(21) Appl. No.: 14/894,136

(22) PCT Filed: May 28, 2013

(86) PCT No.: PCT/EP2013/060908
§ 371 (c)(1),
(2) Date: Nov. 25, 2015

(87) PCT Pub. No.: WO2014/191019
PCT Pub. Date: Dec. 4, 2014

(65) Prior Publication Data
US 2016/0130047 A1 May 12, 2016

(51) Int. Cl.
*B65D 47/08* (2006.01)

(52) U.S. Cl.
CPC ..... *B65D 47/0804* (2013.01); *B65D 47/0809* (2013.01); *B65D 2101/003* (2013.01); *B65D 2251/02* (2013.01); *B65D 2251/105* (2013.01); *B65D 2251/1033* (2013.01); *B65D 2251/1058* (2013.01)

(58) Field of Classification Search
CPC ..... B65D 47/0804; B65D 47/0809; B65D 2101/003; B65D 2251/1033; B65D 2251/1058; B65D 2251/105; B65D 2251/02
See application file for complete search history.

(56) References Cited

U.S. PATENT DOCUMENTS

| | | | | |
|---|---|---|---|---|
| 5,547,091 | A * | 8/1996 | Neveras | B65D 35/14 215/237 |
| 5,579,957 | A | 12/1996 | Gentile | |
| 5,697,509 | A | 12/1997 | Hayes | |
| 5,865,353 | A * | 2/1999 | Baudin | B65D 47/0814 215/235 |
| 5,996,859 | A * | 12/1999 | Beck | B65D 47/0809 215/237 |
| 8,292,101 | B1 * | 10/2012 | Bragg | B65D 50/046 215/237 |
| 8,413,832 | B2 * | 4/2013 | Mazurkiewicz | B65D 47/0804 215/235 |
| 2011/0100990 | A1 | 5/2011 | Clodfelter | |

FOREIGN PATENT DOCUMENTS

| | | | |
|---|---|---|---|
| FR | 2591571 | A1 | 6/1987 |
| WO | 9959886 | A1 | 11/1999 |

* cited by examiner

*Primary Examiner* — Frederick C Nicolas
(74) *Attorney, Agent, or Firm* — Wood, Phillips, Katz, Clark & Mortimer

(57) ABSTRACT

The present invention relates to a dispensing closure including a base and a cover attached to the base by a hinge and movable between an opened and a closed position. The cover includes an outer side-wall with a push-button region. The push-button region has, in a first position, a flat or convex outer surface and is adapted such that it can be pushed by a user at least partly in an inward direction from the first position into a second position. The push-button region has, in the second position, at least partly a concave outer surface.

8 Claims, 3 Drawing Sheets

DISPENSING CLOSURE

FIELD OF THE INVENTION

The present invention relates to a dispensing closure, which can be attached to a container, while such containers are arranged for storing a fluid or another flowable medium, which can be dispensed through an opening of the dispensing closure.

BACKGROUND OF THE INVENTION

Different types of closures are known, one type of such closures are so-called flip-top closures which comprise a base and a cover being attached to said base by a hinge and being movable between an opened and a closed position.

Such flip-top closures are, for example, known from WO 2012/136230.

BRIEF SUMMARY OF THE INVENTION

It is an object of the present invention to provide a dispensing closure which provides an enhanced or alternative handling for the user and which especially enables an easy and secure handling by the user.

This object is solved by a dispensing closure according to one or more of the claims.

According to the present invention, the dispensing closure comprises a base and a cover, being attached to said base by a hinge and being movable between an opened and a closed position, while said cover comprises an outer side-wall, thereby realizing a so-called flip-top closure.

According to the present invention, said outer side-wall of said cover comprises a push-button region or a push area, wherein said push-button region or push area is adapted such that it has a first and a second position, while it is adapted such that it can be pushed by a user at least partly in an inward or radial inward direction from said first position into said second position.

The first position is typically and preferably the position of the push-button region after manufacturing and before a first utilization and opening of the closure by a user, so that the first position is also the initial position or position after manufacturing or original position. In this initial or first position the push-button region or push area has a substantially flat or a substantially convex outer surface.

When the push-button region or push area has been pushed by a user partly in an inward or radial inward direction into said second position, said push-button region has, in this second position, at least partly a concave outer surface, preferably the outer surface of the push-button region is concave over the complete area of the push-button region.

The outer side-wall of said cover is the side-wall of the cover being directed to the outside, when said cover is in said closed position, i.e. the side-wall of said cover which can be touched by the user when said cover is in its closed position. Also the outer surface of said push-button region, forming part of the outer side-wall of said cover, is the surface being directed to the outside when the cover is in its closed position.

The "inward direction" into which the push-button region can be pushed by user from said first into said second position is a direction which has at least a component directed to the inside of a space or volume covered by said cover and being typically defined between said cover and said base, when said cover is in its closed position.

The dispensing closure according to the present invention has the advantage that it is difficult or impossible for a user to move the cover from a closed into an open position by manipulating the push-button region, when this push-button region is in the first or initial position, as it is flat or concave and does not provide a suitable point of application for the user to exert an opening force onto the cover when manipulating and touching or trying to exert a force on the push-button region or push area.

When, however, the user has pushed the push-button region in a radial inward direction and when said push-button region is in its second position, having a concave outer surface, the concave outer surface provides a useful point of application, as the user can place a finger or a fingertip into the concave outer surface and can thereby easily exert a sufficient force to move the closure from its closed position into an open position.

When, for example, opening the closure for the first time, the user can essentially open the closure in one continuous movement, namely by placing his finger onto said push-button region, pushing it inwardly into the second position and then directly opening the cover by lifting the cover relative to the base and thereby essentially rotating the cover around the hinge into the opened position.

The dispensing closure according to the invention has therefore the advantage to provide an easy way for the user to open a cover, while, on the other side, an inadvertent opening can be prevented or at least can be made difficult by very simple and also inexpensive but effective means, as no points of application or actuating protrusions or levers or similar elements of the cover or outer recesses of the base of the cover in order to have the cover protruding over these recesses have to be provided as in conventional closure designs in order to enable the user to open a cover, because such a point of application is created only when needed by pushing the push-button region into said second position. As long as the push-button region is therefore still in its initial or first position, it is very difficult to move the cover from its closed into its opened position.

With the present invention it is therefore possible to provide a dispensing closure which can have an outer form with essentially no protrusions or indentations, which may inadvertently lead to an undesired opening of the cover, e.g. during transport. Furthermore it would be also possible to provide a closure without any latching or locking mechanism, in order to avoid an inadvertent opening of the closure, but it would be possible to realize a certain tendency to keep the cover in a closed position, e.g. simply by friction, as the risk of an inadvertent opening force is remarkably lower than in the conventional designs.

According to a preferred embodiment, said push-button region has an essentially circular or an essentially oval form. This has the advantage that this area matches the form of a fingertip, so that the push-button region or push area can easily be pushed inwardly and also a fingertip can be easily and suitably placed into the concave outer surface of the push-button region in its second position in order to exert an opening force onto said cover.

According to a further preferred embodiment, said push-button region is connected to the remaining area of said outer-side wall of said cover by an intermediate connecting region. This intermediate connecting region can be preferably arranged such that the movement of the push-button region of said first position to said second position is enhanced, while said intermediate connecting region is preferably realized such that the push-button region remains in said first or said second position, if no force is exerted by a user onto said push-button region.

According to a further preferred embodiment, said intermediate connecting region is adapted such that some parts of said intermediate connecting region break when the push-button region is moved from said first position to said second position or alternatively at least some parts of said intermediate connecting region break when said push-button region is moved back from said second position into said first position after it has been moved by a user into the second position in beforehand. The intermediate connecting region can thereby serve as an indicating or a tamper-evident element, while in the first above-mentioned alternative the intermediate connecting region acting as a tamper-evident element partly breaks already when the push-button region is moved from the first into the second position, i.e. into a position in which the dispensing closure can be opened during normal utilization.

As, however, the push-button region in its second position already indicates to the user that the closure is in a status which enables or supports opening of the cover, due to the now concave form, it would be alternatively possible to realize the intermediate connecting region only such that it only partly or even fully breaks when the push-button region is moved back into its first position, in order to avoid any potential tampering by a user, as then either said intermediate connecting region is at least partly broken or said push-button region is in its second position with the concave outer surface.

These functions of the intermediate connecting region can be realized by different means, e.g. a thickness of the intermediate region can be adapted such that it is at least partly thinner than the thickness of said push-button region and/or of said remaining outer side-wall. Alternatively it would be possible to choose, at least partly, a material for the intermediate connecting region being different from the material of the push-button region or the remaining part of the cover.

According to a preferred embodiment, the outer surface of said push-button region has, at least in some areas or preferably over the complete area of the push-button region, a friction coefficient being higher than the friction coefficient of the remaining part of the cover. This has the advantage that a fingertip being placed into the concave outer surface of the push-button region in its second position is able to exert a higher opening force onto the cover.

The friction coefficient can be enhanced e.g. by increasing the roughness of the surface, while, for example, maintaining the same material. However, it would be also possible to increase the friction coefficient by utilizing a different material for the push-button region or by coating the push-button region, either partly or over the complete area of the push-button region.

According to a further preferred embodiment, the closure is arranged such that said base has a groove on its upper side, while said cover is adapted such that a lower rim of said cover is partly or preferably completely covered by side-walls of said groove, when said cover is in its closed position. Both the groove and the lower rim of said cover are preferably extending substantially around the complete circumference of said closure, while in some embodiments only certain areas, typically around the hinge, are designed differently.

This realization would have the advantage that the lower rim, being covered by said groove, does not provide a point of application like e.g. a protrusion, which could be used by a user to exert an opening force onto said cover. This would make it impossible or at least more difficult for a user to exert a sufficient force onto said cover in order to move the cover into its opened position, when not pushing the push-button region into its second position.

Furthermore said groove and said lower rim can be arranged such that a predetermined resistance or friction force is created when said lower rim of said cover is within said groove, so that an increased force will have to be applied in order to move said lower rim of said cover out of said groove. This can be realized by e.g. simply selecting the dimensions of said lower rim of said cover and said groove respectively, such that a friction force has to be overcome to move said lower rim out of said groove, and the effect can be enhanced by e.g. realizing a predetermined friction coefficient of the lower rim of said cover and/or of said groove.

In one embodiment said intermediate connecting region comprises at least one indicator element, which is adapted such that it is at least partly destroyed when said push-button region is moved from the first position into the second position or when said push-button region is moved back from said second position to said first position. By providing such an indicator element, a tamper-evident function is realized in a preferred way.

As an example, such at least one indicator element can be made by a material being different from the material used for the remaining parts of the intermediate connecting region, and can be e.g. realized by a material being more rigid than the remaining parts than the remaining parts of the intermediate connecting region. This would have the advantage that especially one indicator element breaks earlier than the remaining parts of the intermediate connecting region, so that the tamper-evident function is realized in a preferable way. Preferably, the at least one indicator element can be also made of the same material as the push-button region or the remaining side-wall of the cover, while preferably only the remaining part of said intermediate connecting region is made of a material being different and preferably being more elastic than the material of the at least one indicator element.

If different materials are utilized for the dispensing closure in such preferred embodiments, it is preferred to manufacture a dispensing closure by bi-injection molding and preferably as a unitary piece.

In a preferred embodiment, the dispensing closure comprises a dome-shaped dispensing spout, and further preferably a cover comprises, on its inner side, a protrusion, which is positioned such that it is at least partly inserted into a dispensing opening of said base, preferably a dispensing opening arranged on said dome-shaped dispensing spout, when said cover is in its closed position, such that the dispensing opening is sealed.

In a further preferred embodiment, the closure comprises a first latch element, which is directly or indirectly attached to the inner side of said outer side-wall of said cover and which is movable from a locking position to an unlocking position, while the closure also comprises a second latch element being directly or indirectly attached to said base, wherein said first and said second latch element are arranged and positioned such that they engage with each other when said cover is in its closed position and when said first latch element is in its locking position. Said first latch element is preferably in its locking position when said push-button region is in said first position while said first latching element is in its unlocking position, when said push-button region is in said second position. Although such latching elements may not be necessary, as the arrangement of the dispensing closure as described above already provides sufficient means in order to avoid an inadvertent opening of the cover, however the arrangement of such first and second latch elements can further enhance a locking function of the cover as long as the push-button region is in its first or initial position.

BRIEF DESCRIPTION OF THE DRAWINGS

These and other features and advantages of the dispensing closure according to the present invention will become even more apparent in view of the figures showing preferred embodiments and the accompanying explanation.

DETAILED DESCRIPTION OF THE PREFERRED EMBODIMENTS

Figure 1:
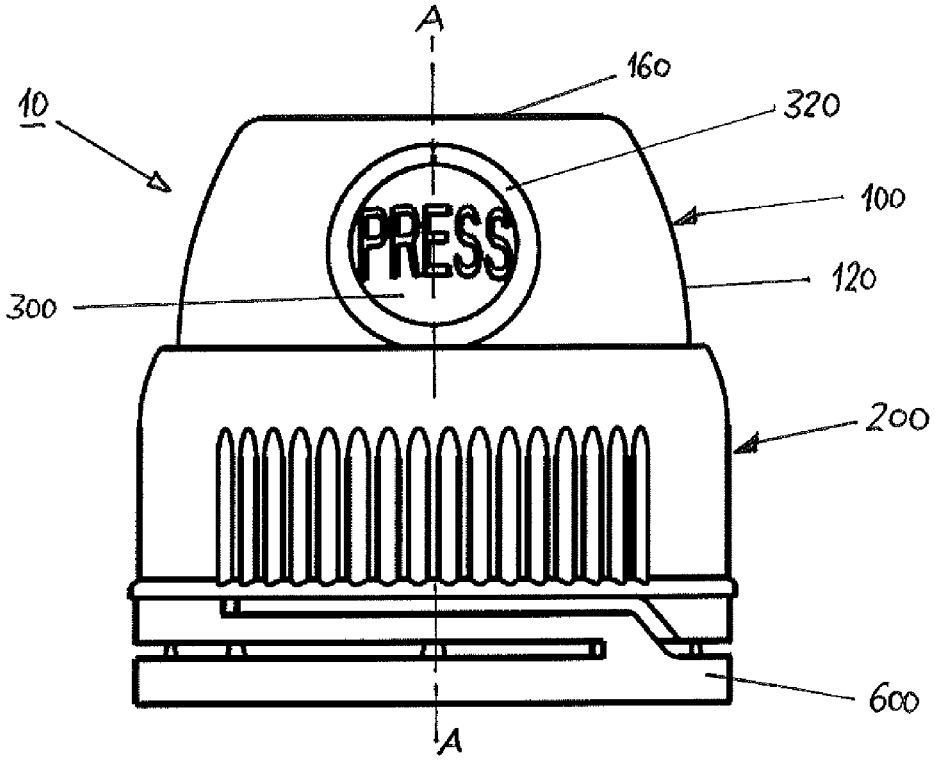
FIG. 1 shows a front view of an embodiment of a dispensing closure according to the present invention with the push-button region in a first position.
Figure 2:
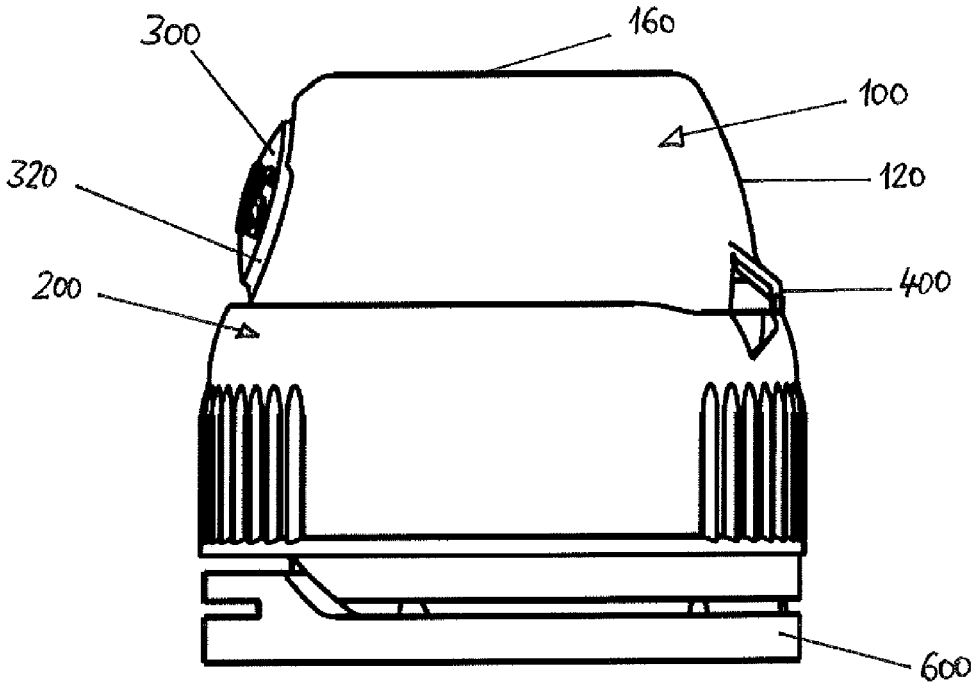
FIG. 2 shows a side-view of an embodiment of the dispensing closure according to the present invention with the push-button region in a first position.

FIGS. 1 and 2 show an embodiment of a dispensing closure 10 according to the present invention in a front view and in a side view. The dispensing closure 10 comprises a base 200 and a cover 100, while said cover 100 is attached to said base 200 by means of a hinge 400, so that the cover 100 can be essentially rotated around the hinge 400, as can be also seen in FIGS. 5 and 6 being described hereinafter.

The base 200 is essentially cylindrical and provides an inner thread (see FIGS. 3 and 4), so that it can be attached to a corresponding outer thread of a container, so that the closure 10 can be attached to a container to cover an opening of such a container.

The cover 100 has an outer side-wall 120, which has a curved outer form, and an essentially flat cover plate 160.

According to the invention, the dispensing closure 10 has a push-button region 300 at the outer side-wall 120 of the cover, while said push-button region 300 has an essentially circular form.

The push-button region 300 in this embodiment is connected with or attached to the remaining part of the outer side-wall 120 by means of an intermediate connecting region 320.

In this embodiment, the intermediate connecting region 320 is made of the same material as the cover 100 and the base 120, namely HDPE. However, the thickness of the intermediate connecting region 320 is thinner than the thickness of the push-button region 300 and the remaining part of the outer side-wall 120.

In this embodiment, the side-wall 120 has a thickness of 0.9 mm and generally the thickness of the side-wall is preferably in the area of about 0.6 mm to 2.0 mm.

The thickness of the push-button region 300 in this embodiment is also 0.5 mm and generally the thickness of the push-button region is in an area of about 0.3 mm to 1.0 mm.

The thickness of the intermediate connecting region 320 in this embodiment is 0.2 mm generally it can be in an area of about 0.05 mm to 0.8 mm.

Figure 3:
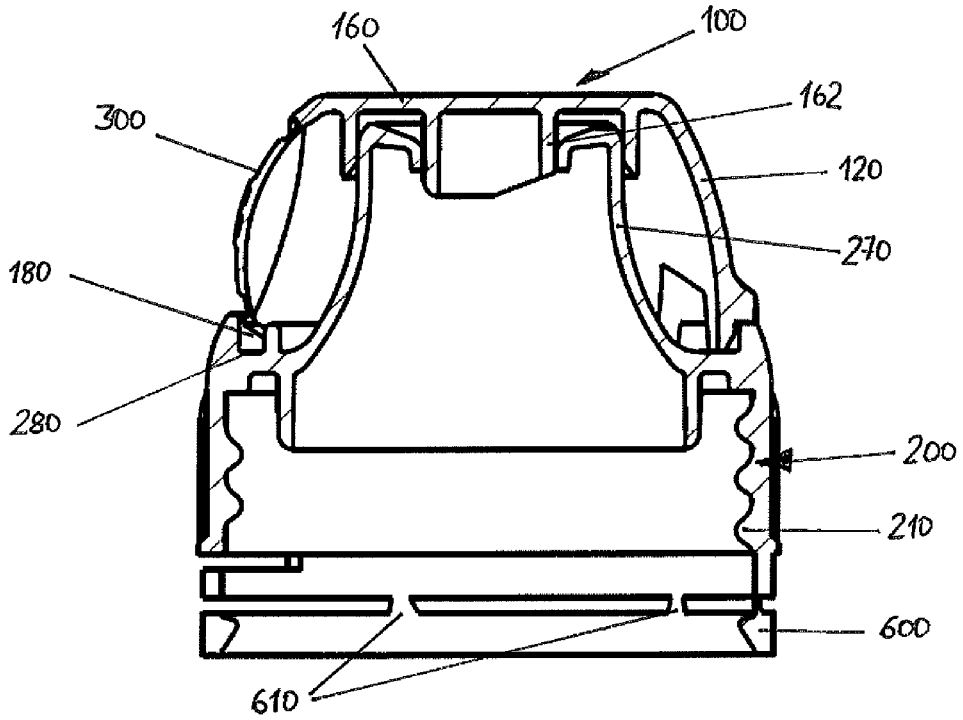
FIG. 3 shows a cross-sectional view of a dispensing closure according to an embodiment of the present invention with the push-button region in a first position.
Figure 4:
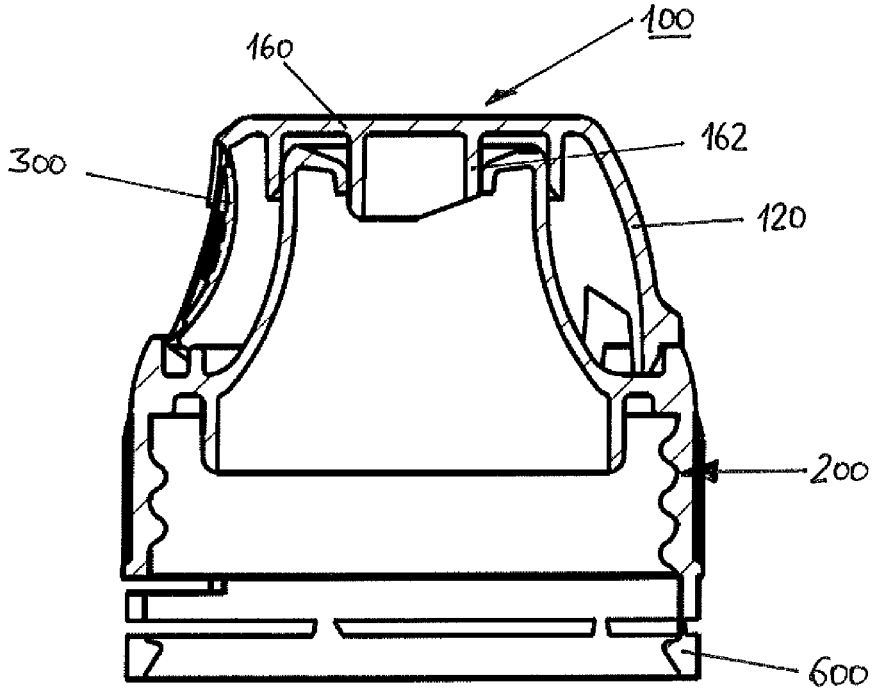
FIG. 4 shows a cross-sectional view through an embodiment of the dispensing closure according to the present invention with the push-button region in a second position.
Figure 5:
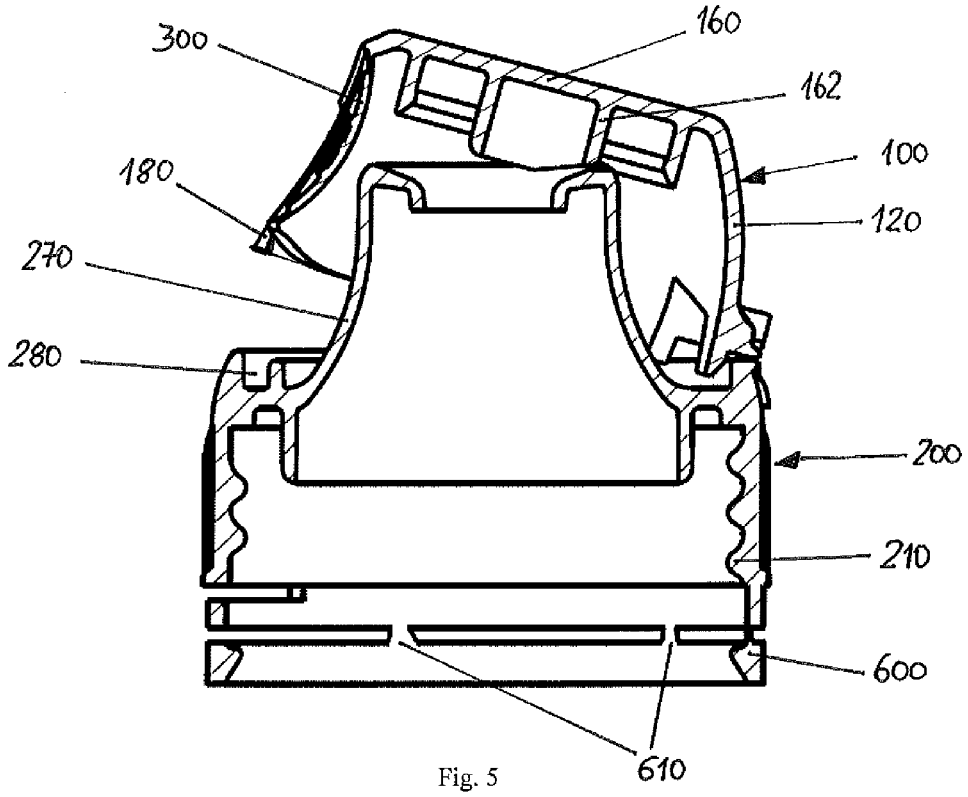
FIG. 5 shows a cross-sectional view of an embodiment of the dispensing closure with the push-button region in a second position and with the cover being partly opened.
Figure 6:
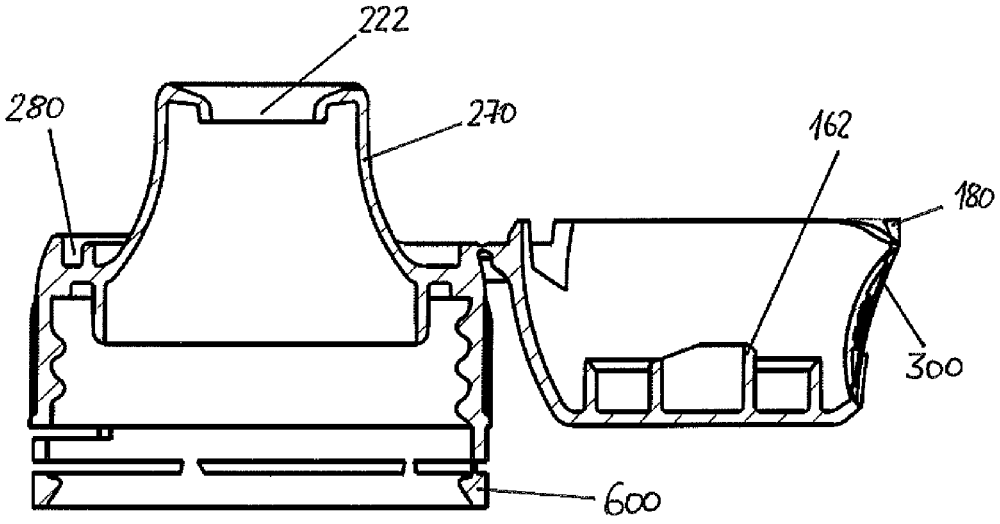
FIG. 6 shows a cross-sectional view of an embodiment of the dispensing closure with the push-button region in a second position and with the cover in its fully opened position.

In this embodiment, the material and the thicknesses of the elements are selected such that the intermediate connecting region 320 does not break when the push-button region is moved between the first position (see FIGS. 1 to 3) and the second position (see FIGS. 4 to 6). However, in other embodiments it would be possible to adapt the cover and especially the material and the thicknesses of the elements such that the intermediate connecting region (320) does not break when the push-button region is moved for the first time, from its initial and first position (see FIGS. 1 to 3) to a second position (see FIGS. 4 to 6), however in case the push-button region is pushed back into the first position, e.g. by exerting a pressure against the push-button region from the inside of the cover 100 when said cover is open, the intermediate connecting region will break at least at one or at multiple points or even completely.

As already mentioned above, the push-button region is shown in FIG. 1 to FIG. 3 in its initial and first position, as provided directly after manufacturing of the dispensing closure.

As can be especially well seen in FIG. 2 and FIG. 3, showing the closure with the cover in its closed position, so that the outer surface of the outer side-wall and the outer surface of said push-button region 300 can be seen from a user from the outside, the push-button region 300 has a concave outer surface, and the curvature of the concave outer surface is in this case higher than the curvature of the outer surface of the side-wall 120. This realization is preferred as thereby the push-button region 300 outwardly extends beyond the outer surface of the outer side-wall, so that it can be more easily manipulated by the user, however it is in principle also possible that the push-button region has a concave curvature being essentially equal to a concave outer surface of the side-wall 120, and it would be even possible that the push-button region 300 has an essentially flat outer surface.

FIG. 3 shows a cross-section through the dispensing closure as shown in FIG. 1 along line A-A as indicated in FIG. 1. In this cross-sectional view, the inner threads 210 of the base 200 for an attachment of the closure 10 to a container can be well seen. Furthermore FIG. 3 very well shows a dome-shaped dispensing spout 270, extending essentially upwardly from said base 200 and having a dispensing opening (222, see especially FIGS. 5 and 6).

The cover 100 comprises, on its inner side and extending from said cover plate 160, a ring-like protrusion 162, which extends into said dispensing opening 222 when said cover 100 is in its closed position, thereby sealing said dispensing opening 222.

The dispensing closure 10 of this embodiment also comprises a tamper-evident element 600, which is arranged such that breaking element 610 will break, when said dispensing closure 10 is unscrewed from the corresponding container for the first time.

The base 200 has, on its upper area, a groove 280, into which a lower rim 180 of said cover 100 is inserted (see especially FIGS. 5 and 6). The groove 280 extends nearly around the completed circumference of the dispensing closure, however the groove is not provided in the area where the hinge 400 is provided.

The lower rim 180 of the cover 100 and the groove 280 are dimensioned such that there is a friction between these two elements when said lower rim 180 of said cover 100 is inserted in said groove 280, so that the opening of the cover 100 requires a predetermined minimum force.

FIG. 4 shows the dispensing closure as shown in FIG. 3, however with the push-button region 300 in its second position. This position is achieved by a user who has pushed the push-button region 300, when being in the initial or first position as shown in FIG. 3, e.g. by a fingertip, in an inward direction.

As can be well seen in FIG. 4, the push-button region 300 has, in this second position, a concave outer surface. As can be also well seen in FIG. 4, it is now easily possible for a user to place a fingertip into the concave outer surface of said push-button region 300, which enables the user to exert an opening force onto said cover 100 such that the cover 100 can be opened, in this embodiment essentially by a rotation around the hinge 400, as can be well seen in FIG. 5 and FIG. 6.

FIG. 5 shows the dispensing closure 10 after the cover 100 has been partly opened such that the ring-like protrusion 162 has moved out of the dispensing opening 222.

FIG. 6 shows the dispensing closure 10 with its cover 100 in its completely opened position, so that the dispensing opening 222 is completely free for dispensing liquid or another flowable medium out of a container to be attached to the dispensing closure 10.

It is clear to the expert that various amendments can be made to the embodiments, without departing from the scope of the present invention as defined by the attached claims, and any features disclosed in connection with the embodiments or the general description can be important for realizing the invention, either alone or in any combination thereof.

What is claimed is:

1. A dispensing closure (10), said dispensing closure (10) comprising: a base (200) and a cover (100), being attached to said base (200) by a hinge (400) and being movable between an opened and a closed position, said cover (100) comprising an outer side-wall (120), characterized in that said outer side-wall (120) of said cover (100) comprises a push-button region (300), wherein said push-button region (300) has, in a first position, a flat or convex outer surface and is configured to be pushed by a user at least partly in an inward direction from said first position into a second position, wherein said push-button region (300) has, in said second position, at least partly a concave outer surface, wherein said push-button region (300) is connected to said outer side-wall (120) of said cover (100) by an intermediate connecting region (320), wherein said intermediate connecting region (320) is adapted such that some parts of said intermediate connecting region (320) break when one of:

(i) said push-button region is moved from said first position to said second position; and (ii) said push-button region is moved back from said second position into said first position.

2. A dispensing closure (10), said dispensing closure (10) comprising: a base (200) and a cover (100), being attached to said base (200) by a hinge (400) and being movable between an opened and a closed position, said cover (100) comprising an outer side-wad (120), characterized in that said outer side-wall (120) of said cover (100) comprises a push-button region (300), wherein said push-button region (300) has, in a first position, a flat or convex outer surface and is configured to be gushed by a user at least partly in an inward direction from said first position into a second position, wherein said push-button region (300) has, in said second position, at least partly a concave outer surface, wherein said push-button region (300) is connected to said outer side-wall (120) of said cover (100) by an intermediate connecting region (320), wherein said intermediate connecting region (320) is configured with sub-regions with a rated breakpoint.

3. A dispensing closure (10), said dispensing closure (10) comprising: a base (200) and a cover (100), being attached to said base (200) by a hinge (400) and being movable between an opened and a closed position, said cover (100) comprising an outer side-wall (120), characterized in that said outer side-wall (120) of said cover (100) comprises a push-button region (300), wherein said push-button region (300) has, in a first position, a flat or convex outer surface and is configured to be pushed by a user at least partly in an inward direction from said first position into a second position, wherein said push-button region (300) has, in said second position, at least partly a concave outer surface, wherein said base (200) has a groove (280) on an upper side of said base (200), said groove (280) having inner side-walls, said groove (280) and said cover (100) are configured such that a lower rim (140) of said cover (100) is at least partly covered by said inner side-walls of said groove (280), when said cover (100) is in said closed position.

4. A dispensing closure (10), said dispensing closure (10) comprising: a base (200) and a cover (100), being attached to said base (200) by a hinge (400) and being movable between an opened and a closed position, said cover (100) comprising an outer side-wall (120), characterized in that said outer side-wall (120) of said cover (100) comprises a push-button region (300), wherein said push-button region (300) has, in a first position, a flat or convex outer surface and is configured to be pushed by a user at least partly in an inward direction from said first position into a second position, wherein said push-button region (300) has, in said second position, at least partly a concave outer surface, wherein said push-button region (300) is connected to said outer side-wall (120) of said cover (100) by an intermediate connecting region (320), wherein said intermediate connecting region (320) comprises at least one indicator element configured to be at least partly destroyed when one of: (i) said push-button region (300) is moved from said first position into said second position; and (ii) said push-button region (300) is moved back from said second position to said first position.

5. The dispensing closure (10) according to claim 4, wherein said at least one indicator element is made from a material that is more rigid than a remaining part of said intermediate connecting region (320).

6. The dispensing closure (10) according to claim 4, wherein said at least one indicator element is made of the same material as one of: (i) said push-button region (300); and (ii) a remaining part of said outer side-wall (120) of said cover (100), and wherein a remaining part of said intermediate connecting region (320) is made of a material that is more elastic than one of: (i) said material of said at least one indicator element (340); and (ii) a material of said cover (100) of said dispensing closure (10).

7. A dispensing closure (10), said dispensing closure (10) comprising: a base (200) and a cover (100), being attached to said base (200) by a hinge (400) and being movable between an opened and a closed position, said cover (100) comprising an outer side-wall (120), characterized in that said outer side-wall (120) of said cover (100) comprises a push-button region (300), wherein said push-button region (300) has, in a first position, a flat or convex outer surface and is configured to be pushed by a user at least partly in an inward direction from said first position into a second position, wherein said push-button region (300) has, in said second position, at least partly a concave outer surface, wherein said cover (100) comprises an inner side having a ring-like protrusion (162) configured to be at least partly inserted into a dispensing opening (222) of said base (200) when said cover (100) is in said closed position to seal said dispensing opening (222).

8. A dispensing closure (10), said dispensing closure (10) comprising: a base (200) and a cover (100), being attached to said base (200) by a hinge (400) and being movable between an opened and a closed position, said cover (100) comprising an outer side-wall (120), characterized in that said outer side-wall (120) of said cover (100) comprises a push-button region (300), wherein said push-button region (300) has, in a first position, a flat or convex outer surface and is configured to be pushed by a user at least partly in an inward direction from said first position into a second position, wherein said push-button region (300) has, in said second position, at least partly a concave outer surface, wherein said dispensing closure (10) comprises (i) a first latch element attached to an inner side of said outer side-wall (120) of said cover (100), said first latch element is movable from a locking position to an unlocking position, and (ii) a second latch element attached to said base (200), wherein said first and said second latch elements are arranged and positioned to engage when said cover (100) is in said closed position and when said first latch element is in said locking position, wherein said first latch element is in said locking position when said push-button region (300) is in said first position, and wherein said first latching element is in said unlocking position, when said push-button region (300) is in said second position.

* * * * *